US011636743B1

(12) United States Patent
Brown

(10) Patent No.: US 11,636,743 B1
(45) Date of Patent: Apr. 25, 2023

(54) HOME SECURITY ASSEMBLY

(71) Applicant: Jonathan Brown, Katy, TX (US)

(72) Inventor: Jonathan Brown, Katy, TX (US)

( * ) Notice: Subject to any disclaimer, the term of this patent is extended or adjusted under 35 U.S.C. 154(b) by 0 days.

(21) Appl. No.: 17/591,716

(22) Filed: Feb. 3, 2022

(51) Int. Cl.

| | |
|---|---|
| ***G08B 13/196*** | (2006.01) |
| ***G08B 27/00*** | (2006.01) |
| ***E03C 1/04*** | (2006.01) |
| ***G08B 25/12*** | (2006.01) |
| ***B05B 1/18*** | (2006.01) |
| ***G08B 5/36*** | (2006.01) |

(52) U.S. Cl.
CPC ..... *G08B 13/196* (2013.01); *B05B 1/185* (2013.01); *E03C 1/0408* (2013.01); *G08B 5/36* (2013.01); *G08B 25/12* (2013.01); *G08B 27/001* (2013.01)

(58) Field of Classification Search
CPC ..... G08B 13/196
See application file for complete search history.

(56) References Cited

U.S. PATENT DOCUMENTS

| | | | |
|---|---|---|---|
| 7,113,091 | B2 | 9/2006 | Script |
| 7,253,732 | B2 | 8/2007 | Osann, Jr. |
| D745,948 | S | 12/2015 | Hanna |
| 9,472,076 | B2 | 10/2016 | Hovang |
| 2011/0216526 | A1 | 9/2011 | Li |
| 2015/0271583 | A1 | 9/2015 | Wan |
| 2016/0129464 | A1 | 5/2016 | Frommer |
| 2021/0000303 | A1* | 1/2021 | Popper ..... A61H 33/063 |

FOREIGN PATENT DOCUMENTS

| | | |
|---|---|---|
| WO | WO2013004613 | 1/2013 |

* cited by examiner

*Primary Examiner* — Travis R Hunnings

(57) ABSTRACT

A home security assembly includes a first shower head to facilitate bathing. A plurality of first light emitters is each of the first light emitters is integrated into the first shower head to emit light outwardly from the first shower head when the first light emitters are turned on. A second shower head is releasably attachable to the first shower head. A plurality of second light emitters is each integrated into the second shower head to emit light outwardly from the second shower head when the second light emitters are turned on. A control unit is integrated into the second shower head and the control unit is in remote communication with an alarm system. Each of the first light emitters and the second light emitters is turned on when the control circuit receives the intruder alert from the alarm system to visually alert the user to the presence of an intruder.

15 Claims, 7 Drawing Sheets

HOME SECURITY ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to security devices and more particularly pertains to a new security device for alerting a person in a shower to the presence of an intruder. The device includes a pair of shower heads that are releasably attachable together. The device includes a control unit that is integrated into a respective one of the shower heads. The device includes a plurality of light emitters that are integrated into the shower heads and a monitor that is integrated into a respective shower head. The control unit is in communication with an alarm system and each of the light emitters and the monitor is turned on when the alarm system detects an intruder.

(2) Description of Related Art Including Information Disclosed Under 37 CFR 1.97 and 1.98

The prior art relates to security devices including a portable security alarm which includes motion detection and an alarm unit. The prior art discloses a home security system that includes a monitor and control unit that are positioned within a master bedroom of a home. The prior art discloses a variety of electronic intruder alarm systems for alerting an occupant of a home to an intruder. The prior art discloses a shower head with light emitters being integrated into the shower head. The prior art discloses a shower head with a water proof speaker integrated into the shower head.

BRIEF SUMMARY OF THE INVENTION

An embodiment of the disclosure meets the needs presented above by generally comprising a first shower head to facilitate bathing. A plurality of first light emitters is each of the first light emitters is integrated into the first shower head to emit light outwardly from the first shower head when the first light emitters are turned on. A second shower head is releasably attachable to the first shower head. A plurality of second light emitters is each integrated into the second shower head to emit light outwardly from the second shower head when the second light emitters are turned on. A control unit is integrated into the second shower head and the control unit is in remote communication with an alarm system. Each of the first light emitters and the second light emitters is turned on when the control circuit receives the intruder alert from the alarm system to visually alert the user to the presence of an intruder.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
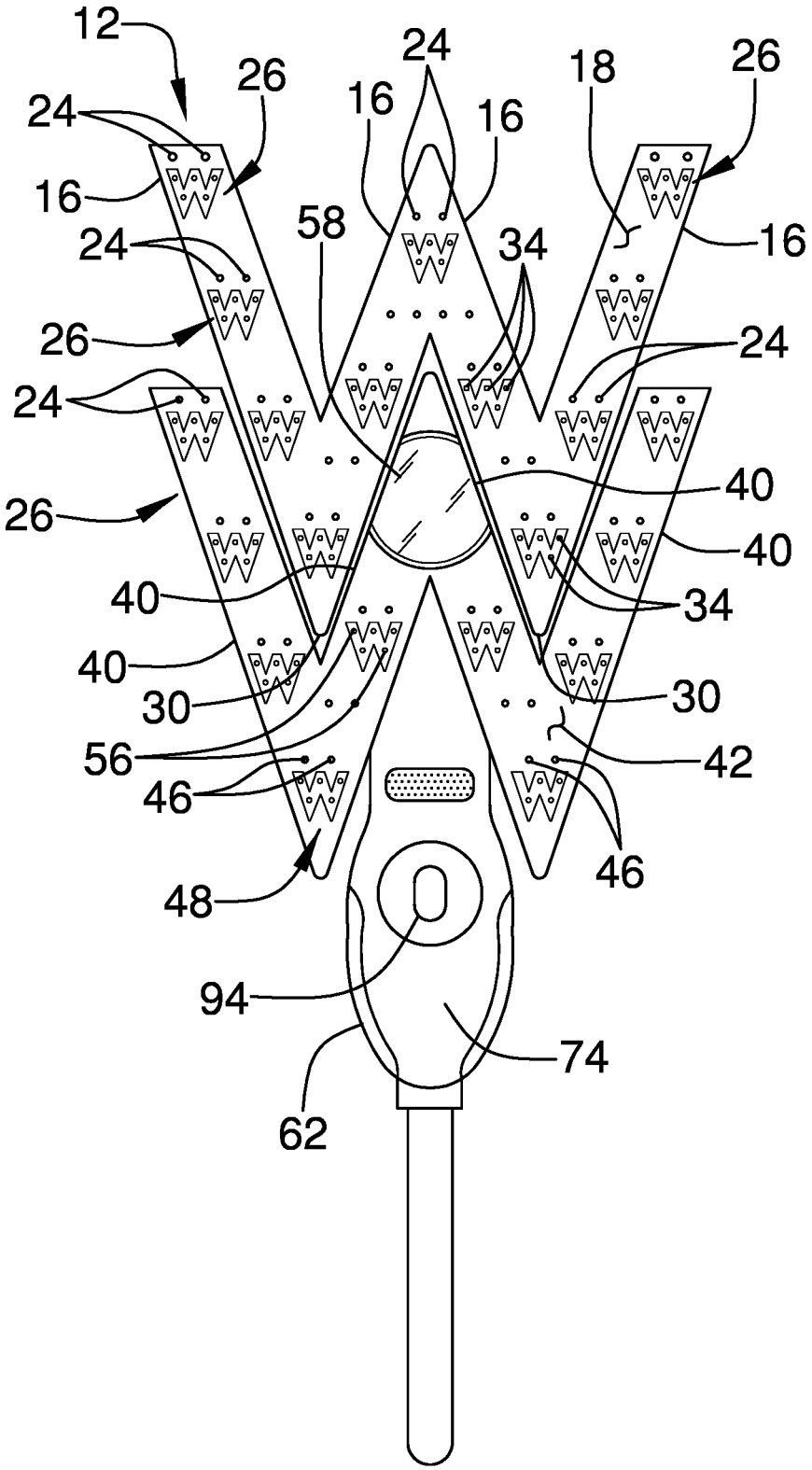
FIG. 1 is a front view of a home security assembly according to an embodiment of the disclosure.
Figure 2:
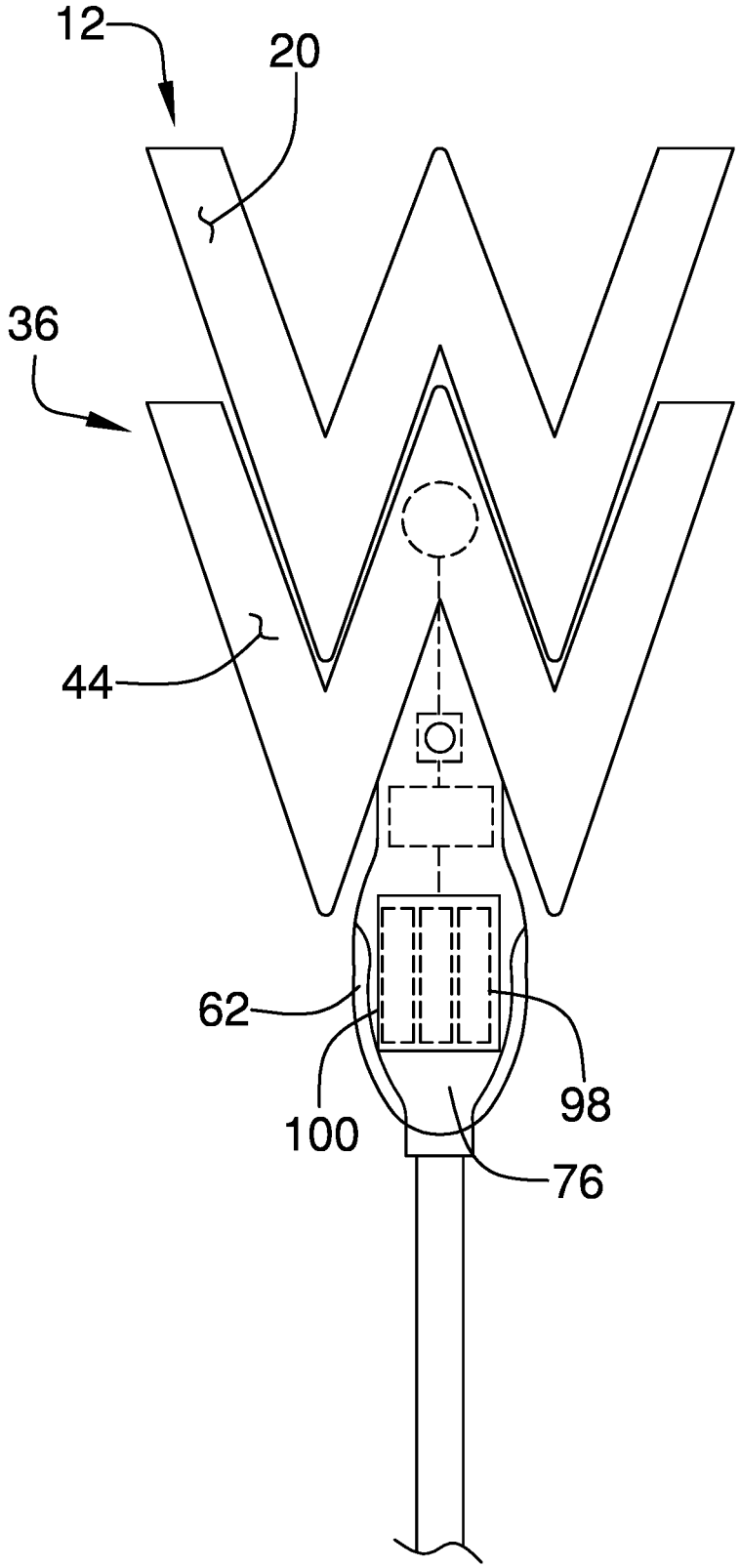
FIG. 2 is a back view of an embodiment of the disclosure.
Figure 3:
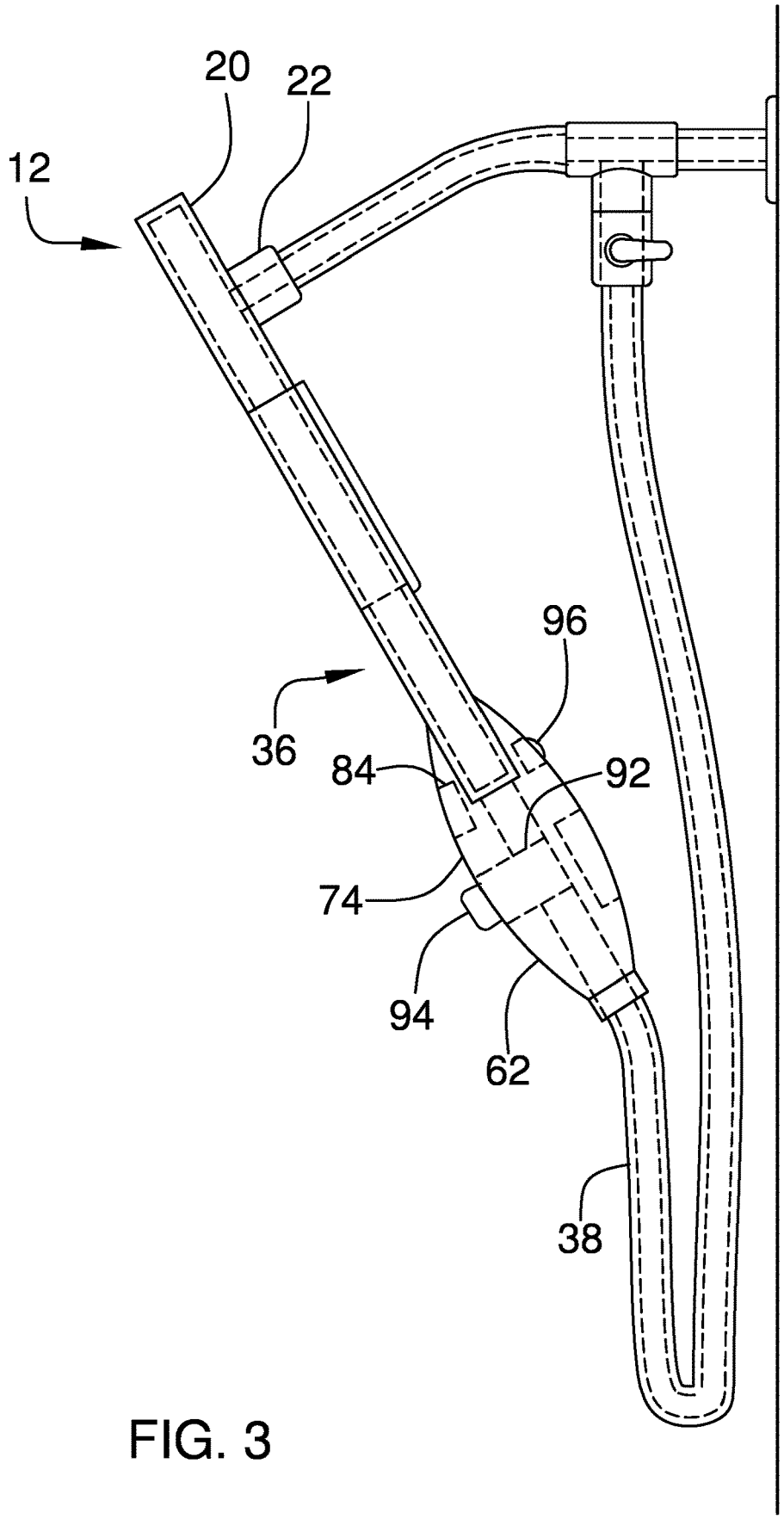
FIG. 3 is a left side phantom view of an embodiment of the disclosure.
Figure 4:
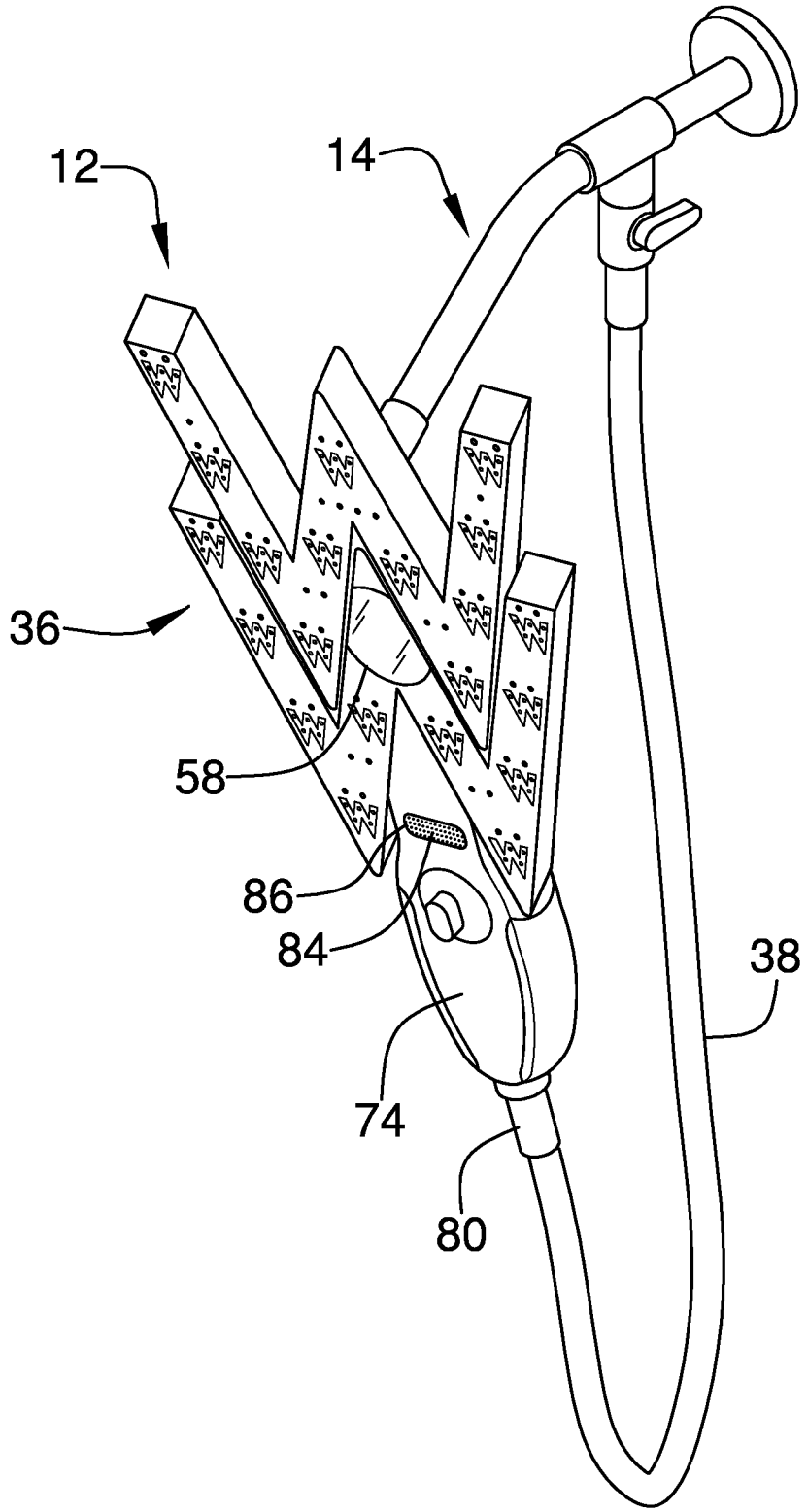
FIG. 4 is a front perspective view of an embodiment of the disclosure.
Figure 5:
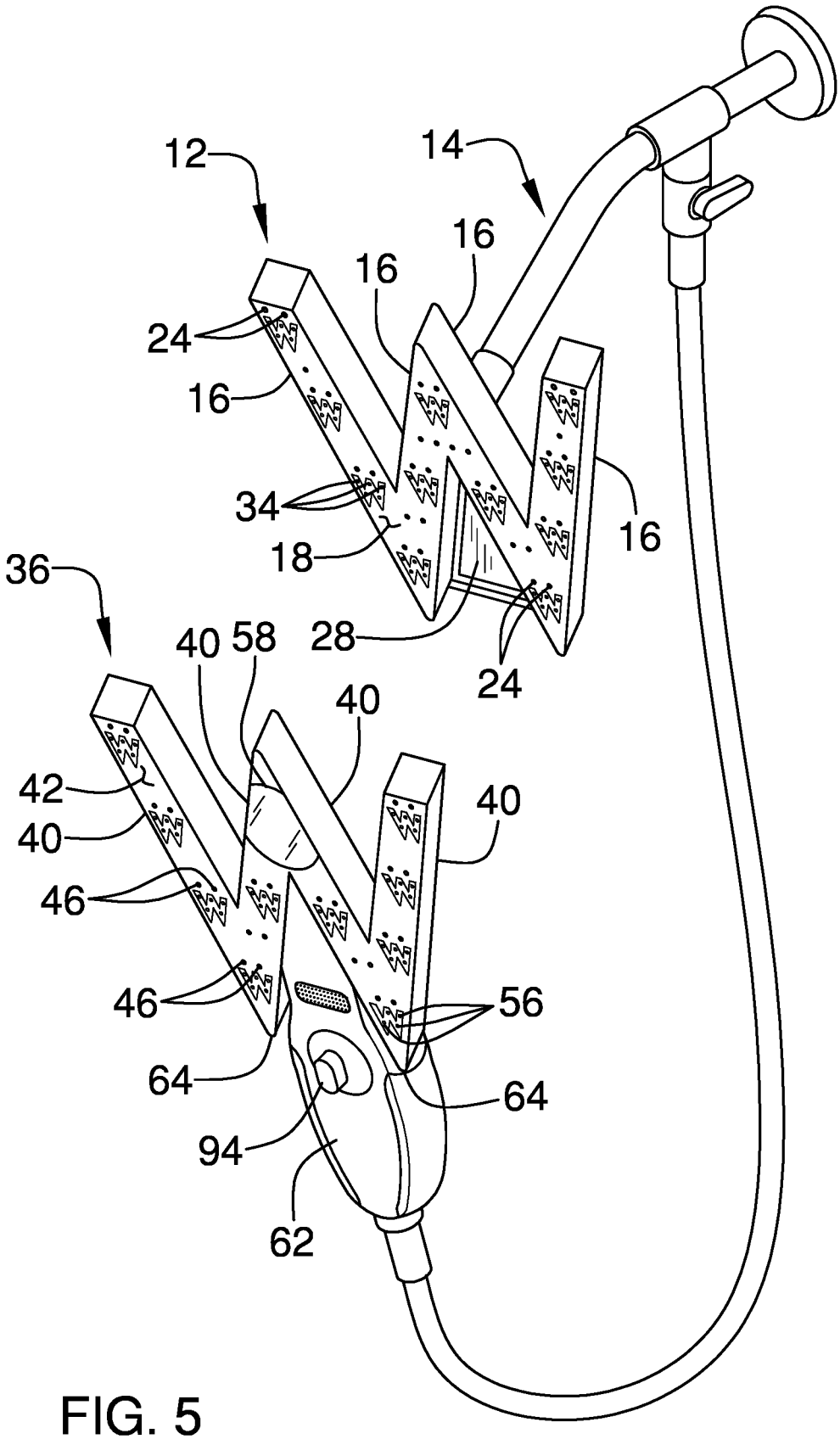
FIG. 5 is a perspective view of an embodiment of the disclosure showing a second shower head being uncoupled from a first shower head.
Figure 6:
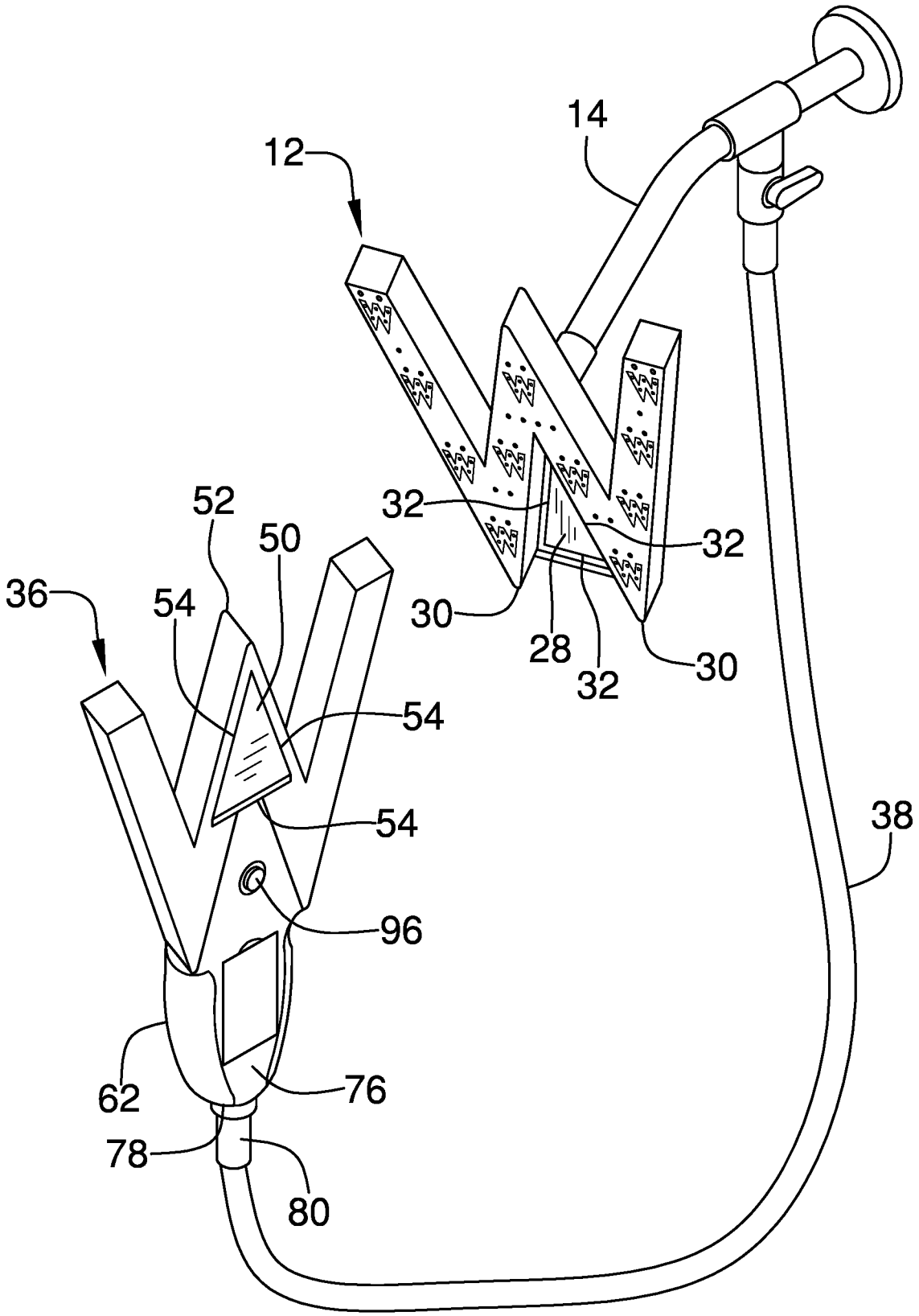
FIG. 6 is a perspective view of an embodiment of the disclosure showing a rear side of a second shower head.
Figure 7:
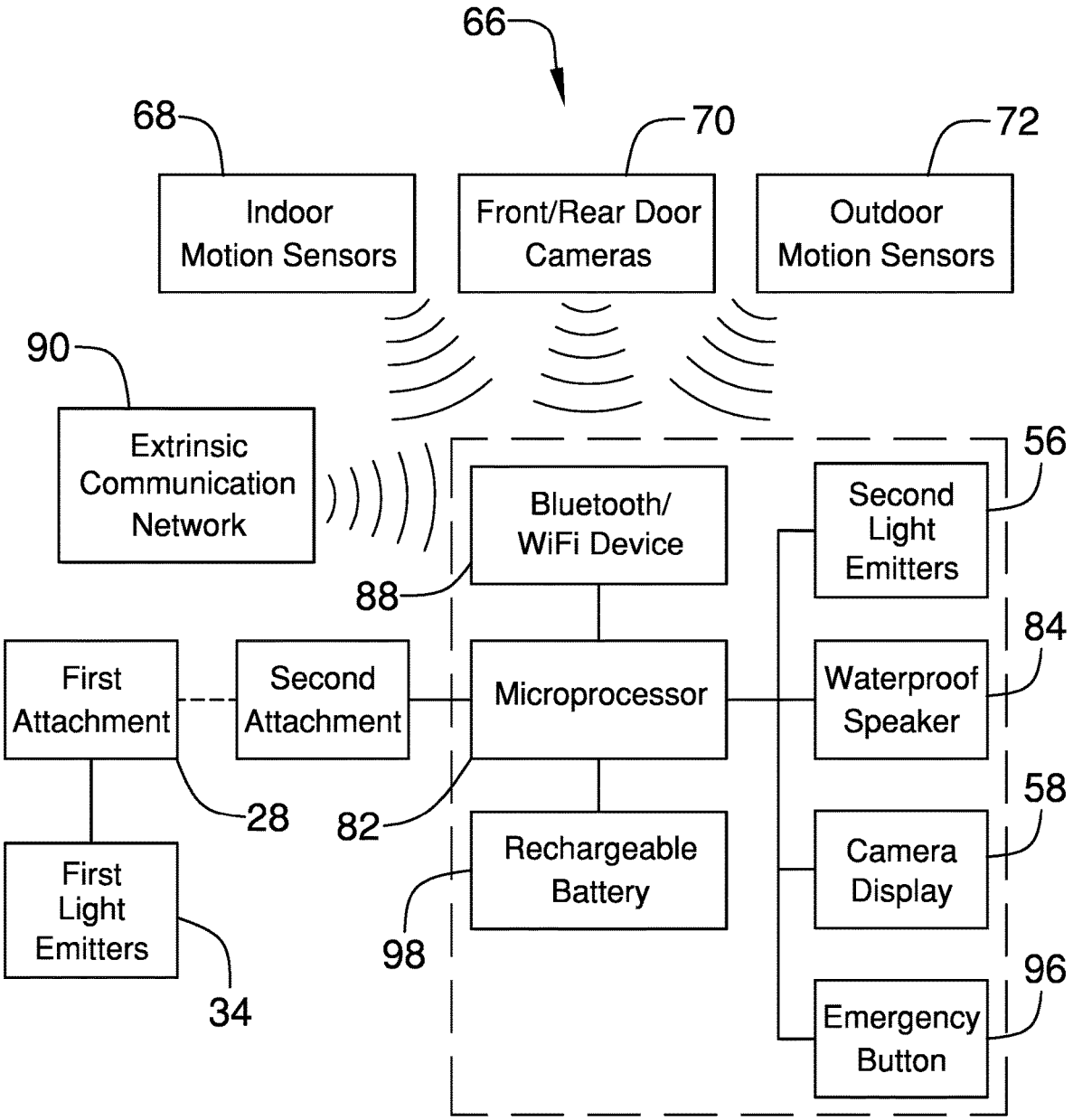
FIG. 7 is a schematic view of an embodiment of the disclosure.

With reference now to the drawings, and in particular to FIGS. 1 through 7 thereof, a new security device embodying the principles and concepts of an embodiment of the disclosure and generally designated by the reference numeral 10 will be described.

As best illustrated in FIGS. 1 through 7, the home security assembly 10 generally comprises a first shower head 12 that is fluidly coupled to a fluid source 14 to facilitate bathing. The fluid source 14 may be a water pipe in a shower or other similar source of water for bathing. The first shower head 12 comprise a plurality of first members 16 intersecting each other such that the first shower head 12 has the ornamental appearance of the letter "W". Each of the first members 16 has a forward surface 18 and a rear surface 20, each of the first members 16 is substantially hollow and each of the first members 16 is in fluid communication with each other.

The rear surface 20 of a respective one of the first members 16 has a fluid port 22 extending into an interior of the respective first member 16 and the fluid port 22 is fluidly coupled to the fluid source 14. The forward surface 18 of each of the first members 16 has a plurality of holes 24 each extending into an interior of the first members 16 to spray fluid outwardly for bathing. The forward surface 18 has indicia 26 printed thereon and the indicia 26 comprise a plurality of letters comprising the letter "W". A first attachment 28 is integrated into the first shower head 12 and the first attachment 28 is positioned between a pair of lower points 30 of the letter "W" defined by the plurality of first members 16. Additionally, the first attachment 28 is comprised of an electrically conductive material. The first attachment 28 may have a plurality of intersecting outer edges 32 such that the first attachment 28 has a triangular shape.

A plurality of first light emitters 34 is provided and each of the first light emitters 34 is integrated into the first shower head 12 to emit light outwardly from the first shower head 12 when the first light emitters 34 are turned on. Each of the first light emitters 34 is positioned on the forward surface 18 of a respective one of the first members 16 and each of the first light emitters 34 is aligned with a respective one of the plurality of letters defined by the indicia 26 on the forward surface 18. Additionally, each of the first light emitters 34 is electrically coupled to the first attachment 28. Each of the first light emitters 34 may comprise a light emitting diode or other type of electronic light emitter. Each of the first light emitters 34 is hermitically sealed such that the first light emitters 34 are not affected by water.

A second shower head 36 is fluidly coupled to a fluid source 38 to facilitate bathing and the second shower head 36 is releasably attachable to the first shower head 12. The fluid source 38 to which the second shower head 36 is fluidly coupled may comprise a water hose that is fluidly coupled to the water pipe to which the first shower head 12 is fluidly attached. The second shower head 36 comprises a plurality of second members 40 intersecting each other such that the second shower head 36 has the ornamental appearance of the letter "W". Each of the second members 40 has a front surface 42 and a back surface 44, each of the second members 40 is substantially hollow and each of the second members 40 is in fluid communication with each other. The front surface 42 of each of the second members 40 has a plurality of holes 46 each extending into an interior of the second members 40 to spray fluid outwardly for bathing. The front surface 42 has indicia 48 printed thereon and the indicia 48 on the front surface 42 comprise a plurality of letters comprising the letter "W".

A second attachment 50 is integrated into the second shower head 36 and the second attachment 50 releasably engages the first attachment 28 for retaining the second shower head 36 on the first shower head 12. The second attachment 50 is comprised of an electrically conductive material such that the second attachment 50 is in electrical communication with the first attachment 28 when the second attachment 50 releasably engages the first attachment 28. Additionally, the second attachment 50 is positioned on the back surface 44 of respective ones of the second members 40 and the second attachment 50 is aligned with an upper point 52 of the letter "W" defined by the plurality of second members 40. The second attachment 50 may have a plurality of intersecting outer edges 54 such that the second attachment 50 has a triangular shape. Additionally, each of the first attachment 28 and the second attachment 50 may comprise a magnet to magnetically engage each other.

A plurality of second light emitters 56 is each integrated into the second shower head 36 to emit light outwardly from the second shower head 36 when the second light emitters 56 are turned on. Each of the second light emitters 56 is positioned on the front surface 42 of a respective one of the second members 40 and each of the second light emitters 56 is aligned with a respective one of the plurality of letters defined by the indicia 48 on the front surface 42. Each of the second light emitters 56 may comprise a light emitting diode or other type of electronic light emitter. A monitor 58 is integrated into the second shower head 36 such that the monitor 58 is visible to a user. The monitor 58 is positioned on the front surface 42 of respective ones of the second members 40 and the monitor 58 is aligned with the upper point 52 of the letter "W" defined by the plurality of second members 40. The monitor 58 may comprise a liquid crystal display or other similar type of electronic monitor. Additionally, each of the second light emitters 56 and the monitor 58 are hermetically sealed such that neither the second light emitters 56 nor the monitor 58 are affected by water.

A control unit 62 is integrated into the second shower head 36 and the control unit 62 is in fluid communication with the second shower head 36. The control unit 62 is in electrical communication with the second attachment 50 and the control unit 62 is positioned between a pair of lower points 64 of the letter "W" defined by plurality of second members 40. The control unit 62 is in remote communication with an alarm system 66 and the control unit 62 is in communication with the monitor 58, each of the first light emitters 34 and each of the second light emitters 56. The alarm system 66 may comprise a residential intruder alarm of any conventional design. The monitor 58 is turned on to display imagery captured by cameras of the alarm system 66 when the control unit 62 receives an intruder alert from the alarm system 66 to facilitate the user to view an intruder. Furthermore, each of the first light emitters 34 and the second light emitters 56 is turned on when the control circuit 62 receives the intruder alert from the alarm system 66 to visually alert the user to the presence of an intruder. As is most clearly shown in FIG. 7, the alarm system 66 may include indoor motions sensors 68, security cameras 70 and outdoor motion sensors 72.

The control unit 62 has a front side 74, a back side 76 and a lower end 78, and a fluid port 80 is fluidly integrated into the lower end 78 and the fluid port 80 on the lower end 78 is fluidly coupled to the fluid source 38 associated with the second shower head 36. Additionally, the second attachment 50 is positioned on the back side 76. A control circuit 82 is integrated into the control unit 62 and the control circuit 82 is electrically coupled to the second attachment 50. The control circuit 82 is electrically coupled to each of the second light emitters 56 and the monitor 58. The control circuit 82 receives an intruder input, and each of the first light emitters 34, the second light emitters 56 and the monitor 58 is turned on when the control circuit 82 receives the intruder input. Additionally, the control circuit 82 receives a communication input.

A speaker 84 is integrated into the control unit 62 to emit an audible alert when the speaker 84 is turned on. The speaker 84 is electrically coupled to the control circuit 82 and the speaker 84 is turned on when the control circuit 82 receives the intruder input. The front side 74 of the control unit 62 has a speaker opening 86 extending into an interior of the control unit 62 and the speaker 84 is aligned with the speaker opening 86. The speaker 84 comprises a water proof speaker such that the speaker 84 is not affected by water. A transceiver 88 is integrated into the control unit 62 and the transceiver 88 is electrically coupled to the control circuit 82. The transceiver 88 is in wireless communication with the alarm system 66 such that the transceiver 88 receives an intruder alert from the alarm system 66 when the alarm system 66 detects an intruder. Additionally, the control circuit 82 receives the intruder input when the transceiver 88 receives the intruder alert.

The transceiver 88 is in wireless communication with an extrinsic communication network 90, such as a cellular phone network, the Internet or other type of wireless communication network. The transceiver 88 broadcasts a communication signal to the extrinsic communication network 90 when the control circuit 82 receives the communication input. In this way the transceiver 88 can request help from emergency responders, such as police officers or other agency that is dispatched by local 911 service. The transceiver 88 may comprise a radio frequency transceiver or the like and the transceiver 88 may employ Bluetooth communication protocols for synching with the alarm system 66.

A valve 92 is integrated into the control unit 62 and the valve 92 is in fluid communication with the fluid port on the lower end 78 of the control unit 62. Additionally, the valve 92 has a flow rate that is adjustable between a minimum rate and a maximum rate. The valve 92 includes a knob 94 that is rotatably disposed on the front side 74 of the control unit 62 to facilitate the knob 94 to be manipulated. The knob 94 adjusts the flow rate of the valve 92 to adjust the flow of fluid which sprays outwardly through the holes 46 in the front surface 42 of the plurality of second members 40.

An emergency button 96 is movably disposed on the back side 76 of the control unit 62 such that the emergency button 96 can be manipulated. The emergency button 96 is electrically coupled to the control circuit 82 and the control circuit 82 receives the communication input when the emergency button 96 is depressed. A power supply 98 is removably integrated into the control unit 62, the power supply 98 is electrically coupled to the control circuit 82 and the power supply 98 comprising at least one rechargeable battery. A battery cover 100 is removably attached to the back side 76 of the control unit 62 and the power supply 98 is positioned beneath the battery cover 100.

In use, the fluid sprays outwardly from the first shower head 12 and the second shower head 36 for bathing. Each of the first light emitters 34 and the second light emitters 56 are turned on when the alarm system 66 detects an intruder. Additionally, the monitor 58 is turned on to display imagery captured by the alarm system 66. In this way the user can be notified of an intruder while the user is showering. The user can depress the emergency button 96 when the user chooses to alert local police of the intruder. In this way the user can shower while being assured that they are safe and secure in what would otherwise be a vulnerable situation.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A home security assembly for notifying a user of an intruder while the user is showering, said assembly comprising:

a first shower head being fluidly coupled to a fluid source wherein said first shower head is configured to facilitate bathing, said first shower head comprising a plurality of first members intersecting each other such that said first shower head has the ornamental appearance of the letter "W";

a first attachment being integrated into said first shower head;

a plurality of first light emitters, each of said first light emitters being integrated into said first shower head wherein each of said first light emitters is configured to emit light outwardly from said first shower head when said first light emitters are turned on;

a second shower head being fluidly coupled to a fluid source wherein said second shower head is configured to facilitate bathing, said second shower head being releasably attachable to said first shower head, said second shower head comprising a plurality of second members intersecting each other such that said second shower head has the ornamental appearance of the letter "W";

a second attachment being integrated into said second shower head, said second attachment releasably engaging said first attachment for retaining said second shower head on said first shower head;

a plurality of second light emitters, each of said second light emitters being integrated into said second shower head wherein each of said second light emitters is configured to emit light outwardly from said second shower head when said second light emitters are turned on;

a monitor being integrated into said second shower head wherein said monitor is configured to be visible to a user; and a control unit being integrated into said second shower head, said control unit being in fluid communication with said second shower head, said control unit being in electrical communication with said second attachment, said control unit being positioned between a pair of lower points of the letter "W" defined by plurality of second members, said control unit being in remote communication with an alarm system, said control unit being in communication with said monitor, each of said first light emitters and each of said second light emitters, said monitor being turned on to display imagery captured by cameras of the alarm system when said control unit receives an intruder alert from the alarm system wherein said monitor is configured to facilitate the user to view an intruder, each of said first light emitters and said second light emitters being turned on when said control circuit receives the intruder alert from the alarm system wherein each of said first light emitters and said second light emitters is configured to visually alert the user to the presence of an intruder.

2. The assembly according to claim 1, wherein each of said first members has a forward surface and a rear surface, each of said first members being substantially hollow, each of said first members being in fluid communication with each other, said rear surface of a respective one of said first members having a fluid port extending into an interior of said respective member, said fluid port being fluidly coupled to the fluid source, said forward surface of each of said first members having a plurality of holes each extending into an interior of said first members wherein each of said holes is configured to spray the fluid outwardly for bathing, said forward surface having indicia being printed thereon, said indicia comprising a plurality of letters comprising the letter "W".

3. The assembly according to claim 2, wherein each of said first light emitters is positioned on said forward surface of a respective one of said first members, each of said light emitters being aligned with a respective one of said plurality of letters defined by said indicia on said forward surface, each of said light emitters being electrically coupled to said first attachment.

4. The assembly according to claim 1, wherein each of said second members has a front surface and a back surface, each of said second members being substantially hollow, each of said second members being in fluid communication with each other, said front surface of each of said second members having a plurality of holes each extending into an interior of said second members wherein each of said holes in said front surface is configured to spray the fluid outwardly for bathing, said front surface having indicia being printed thereon, said indicia on said front surface comprising a plurality of letters comprising the letter "W".

5. The assembly according to claim 4, wherein said second attachment is comprised of an electrically conductive material such that said second attachment is in electrical communication with said first attachment when said second attachment releasably engages said first attachment, said second attachment being positioned on said back surface of respective ones of said second members, said second attachment being aligned with an upper point of said letter "W" defined by said plurality of second members.

6. The assembly according to claim 4, wherein each of said second light emitters is positioned on said front surface of a respective one of said second members, each of said light emitters being aligned with a respective one of said plurality of letters defined by said indicia on said front surface.

7. The assembly according to claim 4, wherein said monitor is positioned on said front surface of respective ones of said second members, said monitor being aligned with an upper point of the letter "W" defined by said plurality of second members.

8. The assembly according to claim 1, wherein said control unit has a front side, a back side and a lower end, said lower end having a fluid port being fluidly integrated into said lower end wherein said fluid port on said lower end is configured to be fluidly coupled to the fluid source, said second attachment being positioned on said back side.

9. The assembly according to claim 1, wherein said control unit includes a control circuit being integrated into said control unit, said control circuit being electrically coupled to said second attachment, said control circuit being electrically coupled to each of said second light emitters, said control circuit being electrically coupled to said monitor, said control circuit receiving an intruder input, each of said first light emitters, said second light emitters and said monitor being turned on when said control circuit receives said intruder input, said control circuit receiving a communication input.

10. The assembly according to claim 9, wherein said control unit includes a speaker being integrated into said control unit wherein said speaker is configured to emit an audible alert when said speaker is turned on, said speaker being electrically coupled to said control circuit, said speaker being turned on when said control circuit receives said intruder input.

11. The assembly according to claim 9, wherein said control unit includes a transceiver being integrated into said control unit, said transceiver being electrically coupled to said control circuit, said transceiver being in wireless communication with the alarm system such that said transceiver receives an intruder alert from the alarm system when the alarm system detects an intruder, said control circuit receiving said intruder input when said transceiver receives said intruder alert.

12. The assembly according to claim 11, wherein said transceiver is in wireless communication with an extrinsic communication network, said transceiver broadcasting a communication signal to the extrinsic communication network when said control circuit receives said communication input wherein said transceiver is configured to request help from emergency responders.

13. The assembly according to claim 8, wherein said control unit includes a valve being integrated into said control unit, said valve being in fluid communication with said fluid port on said lower end of said control unit, said valve having a flow rate being adjustable between a minimum rate and a maximum rate, said valve including a knob being rotatably disposed on said front side of said control unit wherein said knob is configured to be manipulated, said knob adjusting said flow rate of said valve wherein said valve is configured to adjust the flow of fluid which sprays outwardly through said holes in said front surface of said plurality of second members.

14. The assembly according to claim 9, wherein said control unit includes an emergency button being movably disposed on said back side of said control unit wherein said emergency button is configured to be manipulated, said emergency button being electrically coupled to said control circuit, said control circuit receiving said communication input when said emergency button is depressed.

15. A home security assembly for notifying a user of an intruder while the user is showering, said assembly comprising:

a first shower head being fluidly coupled to a fluid source wherein said first shower head is configured to facilitate bathing, said first shower head comprising a plurality of first members intersecting each other such that said first shower head has the ornamental appearance of the letter "W", each of said first members having a forward surface and a rear surface, each of said first members being substantially hollow, each of said first members being in fluid communication with each other, said rear surface of a respective one of said first members having a fluid port extending into an interior of said respective member, said fluid port being fluidly coupled to the fluid source, said forward surface of each of said first members having a plurality of holes each extending into an interior of said first members wherein each of said holes is configured to spray the fluid outwardly for bathing, said forward surface having indicia being printed thereon, said indicia comprising a plurality of letters comprising the letter "W";

a first attachment being integrated into said first shower head, said first attachment being positioned between a pair of lower points of the letter "W" defined by said plurality of first members, said first attachment being comprised of an electrically conductive material;

a plurality of first light emitters, each of said first light emitters being integrated into said first shower head wherein each of said first light emitters is configured to emit light outwardly from said first shower head when said first light emitters are turned on, each of said first light emitters being positioned on said forward surface of a respective one of said first members, each of said light emitters being aligned with a respective one of said plurality of letters defined by said indicia on said forward surface, each of said light emitters being electrically coupled to said first attachment;

a second shower head being fluidly coupled to a fluid source wherein said second shower head is configured to facilitate bathing, said second shower head being releasably attachable to said first shower head, said second shower head comprising a plurality of second members intersecting each other such that said second shower head has the ornamental appearance of the letter "W", each of said second members having a front surface and a back surface, each of said second members being substantially hollow, each of said second members being in fluid communication with each other, said front surface of each of said second members having a plurality of holes each extending into an interior of said second members wherein each of said holes in said front surface is configured to spray the fluid outwardly for bathing, said front surface having indicia being printed thereon, said indicia on said front surface comprising a plurality of letters comprising the letter "W";

a second attachment being integrated into said second shower head, said second attachment releasably engaging said first attachment for retaining said second shower head on said first shower head, said second attachment being comprised of an electrically conductive material such that said second attachment is in electrical communication with said first attachment when said second attachment releasably engages said first attachment, said second attachment being positioned on said back surface of respective ones of said second members, said second attachment being aligned with an upper point of said letter "W" defined by said plurality of second members;

a plurality of second light emitters, each of said second light emitters being integrated into said second shower head wherein each of said second light emitters is configured to emit light outwardly from said second shower head when said second light emitters are turned on, each of said second light emitters being positioned on said front surface of a respective one of said second members, each of said light emitters being aligned with a respective one of said plurality of letters defined by said indicia on said front surface;

a monitor being integrated into said second shower head wherein said monitor is configured to be visible to a user, said monitor being positioned on said front surface of respective ones of said second members, said monitor being aligned with an upper point of the letter "W" defined by said plurality of second members;

a control unit being integrated into said second shower head, said control unit being in fluid communication with said second shower head, said control unit being in electrical communication with said second attachment, said control unit being positioned between a pair of lower points of the letter "W" defined by plurality of second members, said control unit being in remote communication with an alarm system, said control unit being in communication with said monitor, each of said first light emitters and each of said second light emitters, said monitor being turned on to display imagery captured by cameras of the alarm system when said control unit receives an intruder alert from the alarm system wherein said monitor is configured to facilitate the user to view an intruder, each of said first light emitters and said second light emitters being turned on when said control circuit receives the intruder alert from the alarm system wherein each of said first light emitters and said second light emitters is configured to visually alert the user to the presence of an intruder, said control unit having a front side, a back side and a lower end, said lower end having a fluid port being fluidly integrated into said lower end wherein said fluid port on said lower end is configured to be fluidly coupled to the fluid source, said second attachment being positioned on said back side;

a control circuit being integrated into said control unit, said control circuit being electrically coupled to said second attachment, said control circuit being electrically coupled to each of said second light emitters, said control circuit being electrically coupled to said monitor, said control circuit receiving an intruder input, each of said first light emitters, said second light emitters and said monitor being turned on when said control circuit receives said intruder input, said control circuit receiving a communication input;

a speaker being integrated into said control unit wherein said speaker is configured to emit an audible alert when said speaker is turned on, said speaker being electrically coupled to said control circuit, said speaker being turned on when said control circuit receives said intruder input;

a transceiver being integrated into said control unit, said transceiver being electrically coupled to said control circuit, said transceiver being in wireless communication with the alarm system such that said transceiver receives an intruder alert from the alarm system when the alarm system detects an intruder, said control circuit receiving said intruder input when said transceiver receives said intruder alert, said transceiver being in wireless communication with an extrinsic communication network, said transceiver broadcasting a communication signal to the extrinsic communication network when said control circuit receives said communication input wherein said transceiver is configured to request help from emergency responders;

a valve being integrated into said control unit, said valve being in fluid communication with said fluid port on said lower end of said control unit, said valve having a flow rate being adjustable between a minimum rate and a maximum rate, said valve including a knob being rotatably disposed on said front side of said control unit wherein said knob is configured to be manipulated, said knob adjusting said flow rate of said valve wherein said valve is configured to adjust the flow of fluid which sprays outwardly through said holes in said front surface of said plurality of second members;

an emergency button being movably disposed on said back side of said control unit wherein said emergency button is configured to be manipulated, said emergency button being electrically coupled to said control circuit, said control circuit receiving said communication input when said emergency button is depressed; and a power supply being removably integrated into said control unit, said power supply being electrically coupled to said control circuit, said power supply comprising at least one rechargeable battery.

* * * * *